US006779754B2

(12) United States Patent
Hellman

(10) Patent No.: US 6,779,754 B2
(45) Date of Patent: Aug. 24, 2004

(54) FIN-STABILIZED ARTILLERY SHELL

(75) Inventor: Ulf Hellman, Karlskoga (SE)

(73) Assignee: Bofors Defence AB (SE)

( * ) Notice: Subject to any disclaimer, the term of this patent is extended or adjusted under 35 U.S.C. 154(b) by 0 days.

(21) Appl. No.: 10/239,520

(22) PCT Filed: Mar. 14, 2001

(86) PCT No.: PCT/SE01/00524

§ 371 (c)(1),
(2), (4) Date: Feb. 4, 2003

(87) PCT Pub. No.: WO01/79779

PCT Pub. Date: Oct. 25, 2001

(65) Prior Publication Data

US 2003/0146342 A1 Aug. 7, 2003

(30) Foreign Application Priority Data

Mar. 21, 2000 (SE) ..... 0000922

(51) Int. Cl.[7] ..... F42B 10/00

(52) U.S. Cl. ..... 244/3.27; 244/3.24; 102/385; 102/454

(58) Field of Search ..... 244/3.23–3.28, 244/3.1, 41, 3.29; 102/384–386, 703, 338–340, 342, 345, 351, 454

(56) References Cited

U.S. PATENT DOCUMENTS 1,218,832 A * 3/1917 Bondurant ..... 102/400
3,158,336 A * 11/1964 Warren et al. ..... 244/160
3,695,556 A * 10/1972 Gauzza et al. ..... 244/3.29
3,702,588 A * 11/1972 Simmons ..... 102/340
3,834,312 A * 9/1974 Simmons ..... 102/339
4,004,514 A * 1/1977 Daniels ..... 102/384
4,798,143 A * 1/1989 Graham ..... 102/370
4,846,071 A 7/1989 Franzen et al.
5,456,427 A * 10/1995 Greenhalgh ..... 244/138 R
6,135,387 A * 10/2000 Seidel et al. ..... 244/3.15
6,336,609 B1 1/2002 Johnsson
6,352,218 B1 3/2002 Holmqvist et al.
6,576,880 B2 * 6/2003 Martorana et al. ..... 244/3.1

FOREIGN PATENT DOCUMENTS

JP 406094397 * 4/1994 ..... 244/3.27

* cited by examiner

*Primary Examiner*—Michael J. Carone
*Assistant Examiner*—L. Semunegus
(74) *Attorney, Agent, or Firm*—Connolly Bove Lodge & Hutz LLP

(57) ABSTRACT

The present invention relates to a long-range artillery shell (1) that is fin-stabilised in its trajectory and which is designed to be fired in a rifled gun barrel and thus has a slipping driving band (8) as main contact surface with the inside of the barrel, and has a so-called base-bleed unit (3) with a number of stabilization fins (9–14) that are deployable after the shell has left the barrel. A special feature of the shell (1) as claimed in the present invention is that the fins (9–14), when activated, are radially displaceable to project outside the external periphery of the shell through slots or through-holes (28) in the wall of the shell, but are initially radially retracted inside the propellant motor section or propellant chamber (4) of the base-bleed unit (3) between dedicated protective walls (16–17) that isolate the fins from the surrounding propelling charges (25) of the propellant motor and also divide the inside of the propellant motor (4) into sectors (18–23) that are separated from each other.

25 Claims, 5 Drawing Sheets

FIN-STABILIZED ARTILLERY SHELL

The present invention relates to a long-range artillery shell that is fin-stabilised in its trajectory and which is designed to be fired in a rifled gun barrel and thus has a so-called slipping driving band as main contact surface with the inside of the barrel and, after it has left the barrel, has deployable stabilisation fins. Special features of the shell as claimed in the present invention are the design of the stabilisation fins, the way they are deployed, and the fact that while retracted they are inside a propellant chamber or propellant motor of a base-bleed unit incorporated in the shell.

A possible reason for choosing a fin-stabilised artillery shell instead of a spin-stabilised shell is that one could want to make it guideable on its way to the target and it is much easier to correct the trajectory of a fin-stabilised shell than a spin-stabilised shell, and this applies irrespective of whether the correction to the trajectory is to be achieved by impulse motors, guidance fins or some other method.

A requirement for the shell as claimed in the present invention is that it shall be possible to provide it with extra long range. A method used increasingly in recent years to achieve extreme long ranges even with old tube-firing artillery is the base-bleed technique used to eliminate rear-end turbulence and the underpressure formed behind shells as they fly through the atmosphere, both of which have a decelerating effect that shortens range. The base-bleed technique involves the installing, in the rear section of the shell, of a combustion chamber filled with slow burning propellant which, while it burns, generates gases that flow out through an orifice in the rear face of the shell at a pre-determined rate, thus eliminating and equalising the decelerating turbulence and underpressure behind the shell.

However, when providing a shell with a base-bleed unit as well as stabilisation fins there arises a problem regarding the location of the latter as the base-bleed unit must be located in the rear of the shell with at least one gas outflow outlet in the rear face of the shell, while the fins also need to be located in the rear section of the shell as far as possible from the centre of gravity of the shell. An extra problem is that to enable the shell to be fired from a rifled barrel the fins must be fully retractable inside the minimum diameter of the barrel while not occupying too large a volume inside the shell thereby preventing the use of this space for the cargo that justifies the existence of the shell.

The present invention now offers a solution to the problem with retractable fins that involves an advantageous function while they are in retracted mode and which enables location of the fins very close to the rear face of the shell, i.e. at precisely the position where they need to be located.

As claimed in the present invention the fins are initially retracted radially or accommodated in the base-bleed unit's propellant chamber or motor section via slots or through-openings in its outer wall. In retracted mode the fins are thus enclosed by radial protective walls that remain in place even after the fins have deployed. Naturally the protective walls and the spaces occupied by the fins occupy a small part of the total volume of the propellant chamber but, at the same time, one obtains what can be considered a division of the propellant chamber into a number of sectors separated from each other by the protective walls of the fin compartments while these sectors remain in mutual contact via a central axial space around the longitudinal axis of the propellant chamber that leads to the above mentioned gas outflow orifice. The present invention, namely, does not permit the fins and the protective walls surrounding them in retracted mode to extend all the way to the central axis of the propellant chamber; instead, they are terminated just before this point.

This arrangement, as claimed in the present invention, provides several advantages. Firstly the fins are optimally located, i.e. at the extreme rear of the shell, and secondly the location of the fins in retracted mode does not impact negatively on the active cargo of the shell, and thirdly the location of the fins involves only a slight extension of the propellant chamber of the base-bleed unit to achieve the same volume that was previously available for an active propellant cargo, and finally by subdividing the propellant chamber into sectors one obtains 'free' access to an efficient division and support of the base-bleed propellant. The latter aspect has shown itself to be at least as important, since previously there were major problems in producing a base-bleed unit suitable for slow-burning propellant elements of sufficient size and strength to withstand the accelerations involved in firing while also holding them together until their active burnout. Consequently, it was previously necessary to devise special propellant supports inside the combustion chamber of the base-bleed unit. An example of such a propellant support in the form of a support cupola initially arranged internally around the outlet nozzle of a base-bleed unit is described in our own Swedish patent number 461477.

To provide the fins with a greater length than is immediately enabled by the diameter of the shell the fins can be given a telescopic function, i.e. each fin is produced in the form of two or more initially—before deployment—telescoped parts. To extend these fin elements, both from their compartments between the protective walls inside the propellant chamber and from each other, parts of the gas pressure that propels the shell from the barrel can be used in a way described in more detail below. This gas pressure can subsequently, to a greater or lesser extent, also be supplemented by the gas pressure generated inside the propellant chamber of the base-bleed unit when the propellant therein is ignited. The available gas pressure is thus used to push the fins through their respective slots in the side wall of the shell and to extend them from their telescoped mode. To provide a desirable seal when the fins have reached their fully deployed position their inner edges should preferably be designed so that they are slightly flared inwards towards the inside of the propellant chamber, so that as soon as they have each reached their fully deployed position they become wedged firmly in their respective slots in the outer wall of the propellant chamber or become wedged/locked at the extremity of each first fin element.

Of course, to provide extension of the telescoped fin elements various completely mechanical devices, such as different types of springs, could alternatively be used. Even combinations of mechanical and gas pressure controlled systems are fully conceivable within the fundamental concept of the present invention.

As indicated above parts of the gas pressure from the firing of the shell can be utilised to deploy the fins. Access to this propellant gas pressure is enabled by allowing it to enter the base-bleed unit, i.e. the unobstructed central passage of the propellant chamber. When the shell exits the barrel from which it is fired there is thus also a pressure inside the propellant chamber of the base-bleed unit that is equivalent to the pressure in the barrel. When the shell leaves the barrel the pressure outside the shell rapidly drops to normal atmospheric pressure, while the pressure inside the propellant chamber drops much more slowly as the sole opening of significance (to achieve pressure equilibrium) is the gas outlet of the base-bleed unit. Thus it is between the time when the shell leaves the barrel and before the pressure inside the base-bleed unit has had time to reach equilibrium (with the ambient atmospheric pressure) that the overpressure available is used to deploy the fins.

A special variant of the present invention utilises a removable protective casing that protects and retains the fins in retracted mode until the shell has left the barrel after being fired. An elementary way of mechanically removing this protective casing also involves using the gas pressure in the barrel during firing and allowing it free access to the inside of the casing. When the shell reaches the muzzle a pressure equal to the pressure in the barrel also exists inside the protective cover, but as soon as the shell exits the muzzle the pressure outside the cover rapidly drops to the ambient atmospheric pressure while the pressure inside the protective cover falls more slowly, resulting in this internal overpressure ejecting the protective cover against the sole smaller resistance offered by the atmospheric pressure. As already described, the same internal overpressure can also be used to deploy the fins.

Radially retracted fins have, of course, existed previously, but as far as we are aware they have never been directly retracted into the propellant chamber of a base-bleed unit in the way described in the present invention, where the fins in retracted mode are also protected by radial support guide-walls that have the double function of acting as active propellant supports.

The present invention is defined in the subsequent patent claims and is now described in more detail with reference to the illustrations shown in the appended FIGS. 1–5.

In the appended figures

FIG. 1 shows a sectioned shell equipped with the characteristic fins, while

FIG. 3 shows a section along plane III—III in FIG. 2, while

Figure 1:
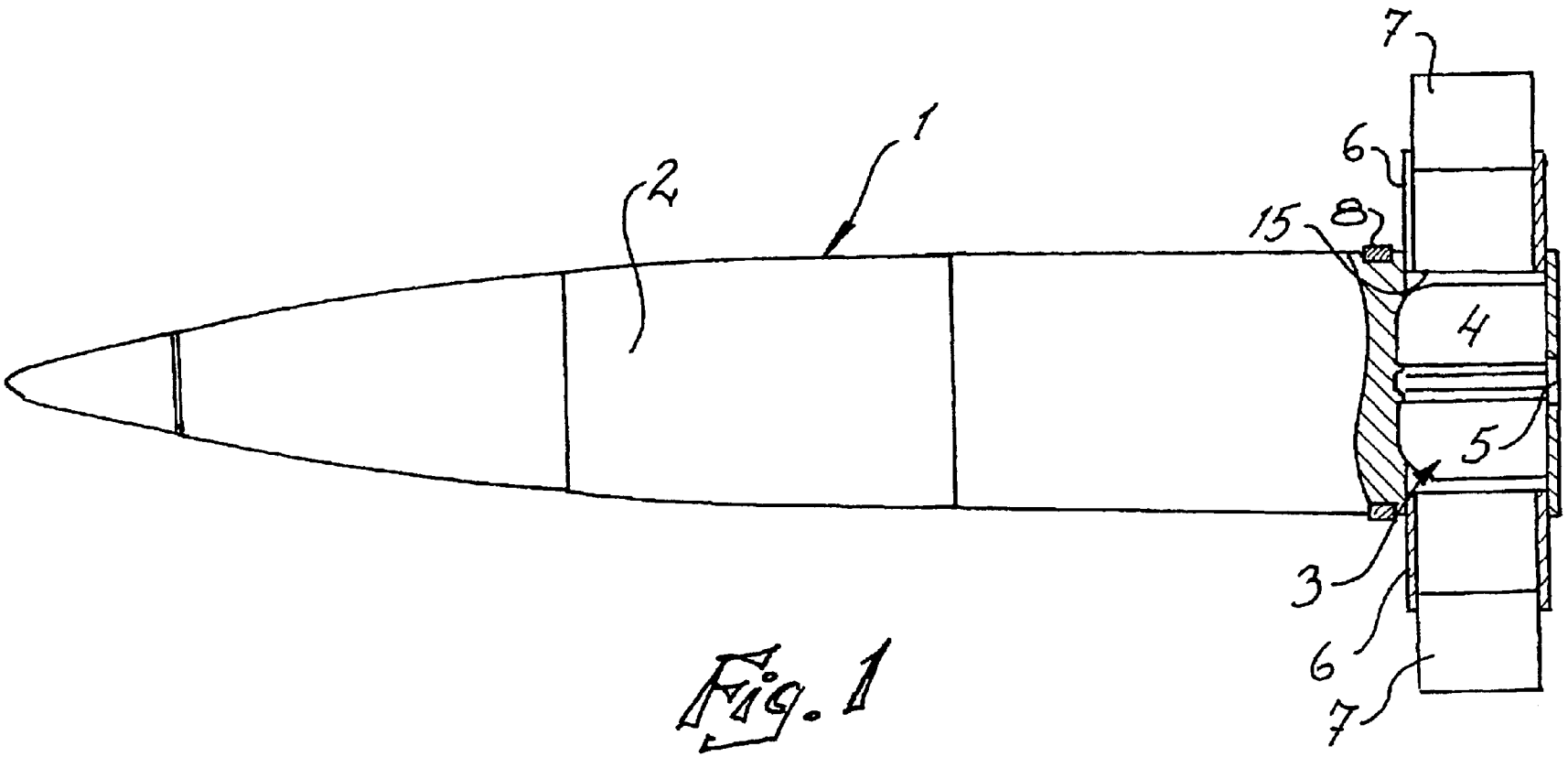
Figure 2:
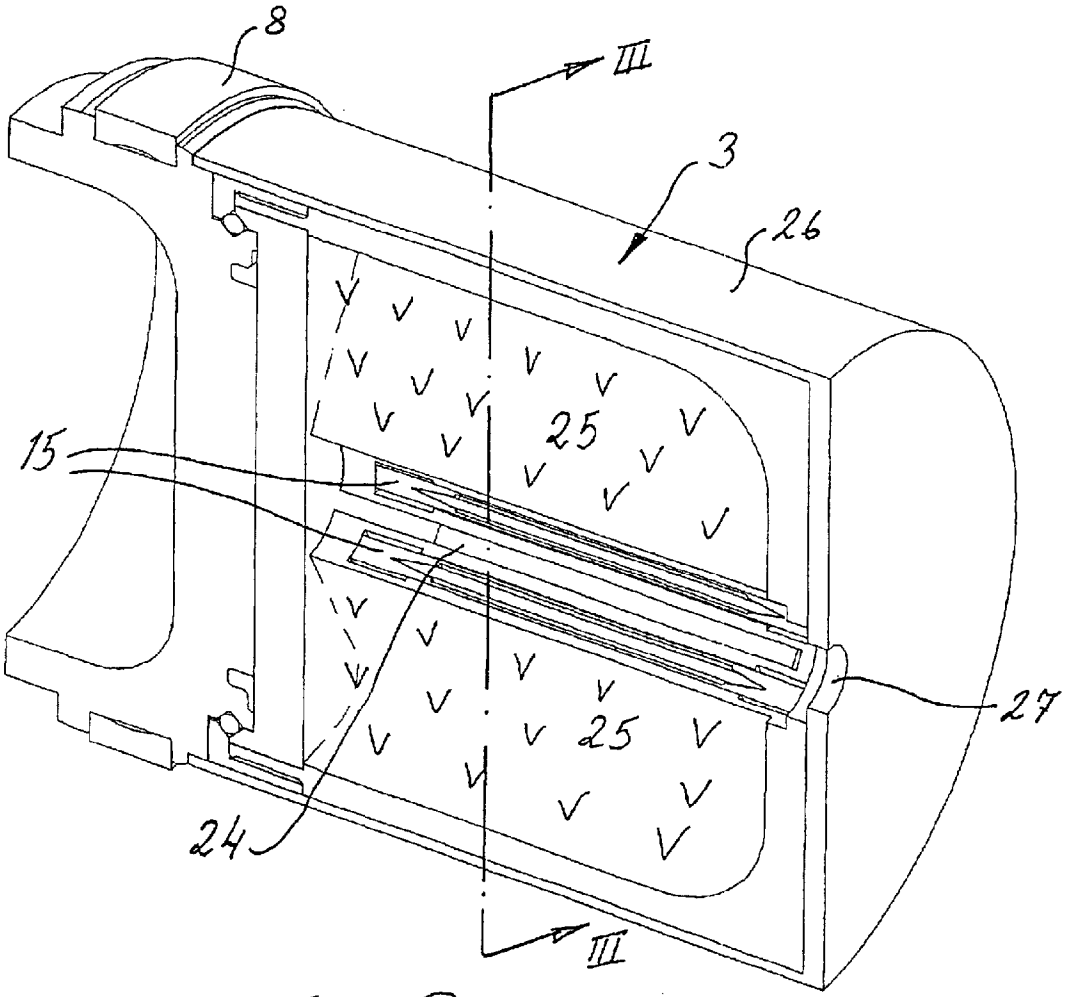
FIG. 2 shows to a larger scale a longitudinal section of the shell's base-bleed unit in pre-launch mode.
Figure 4:
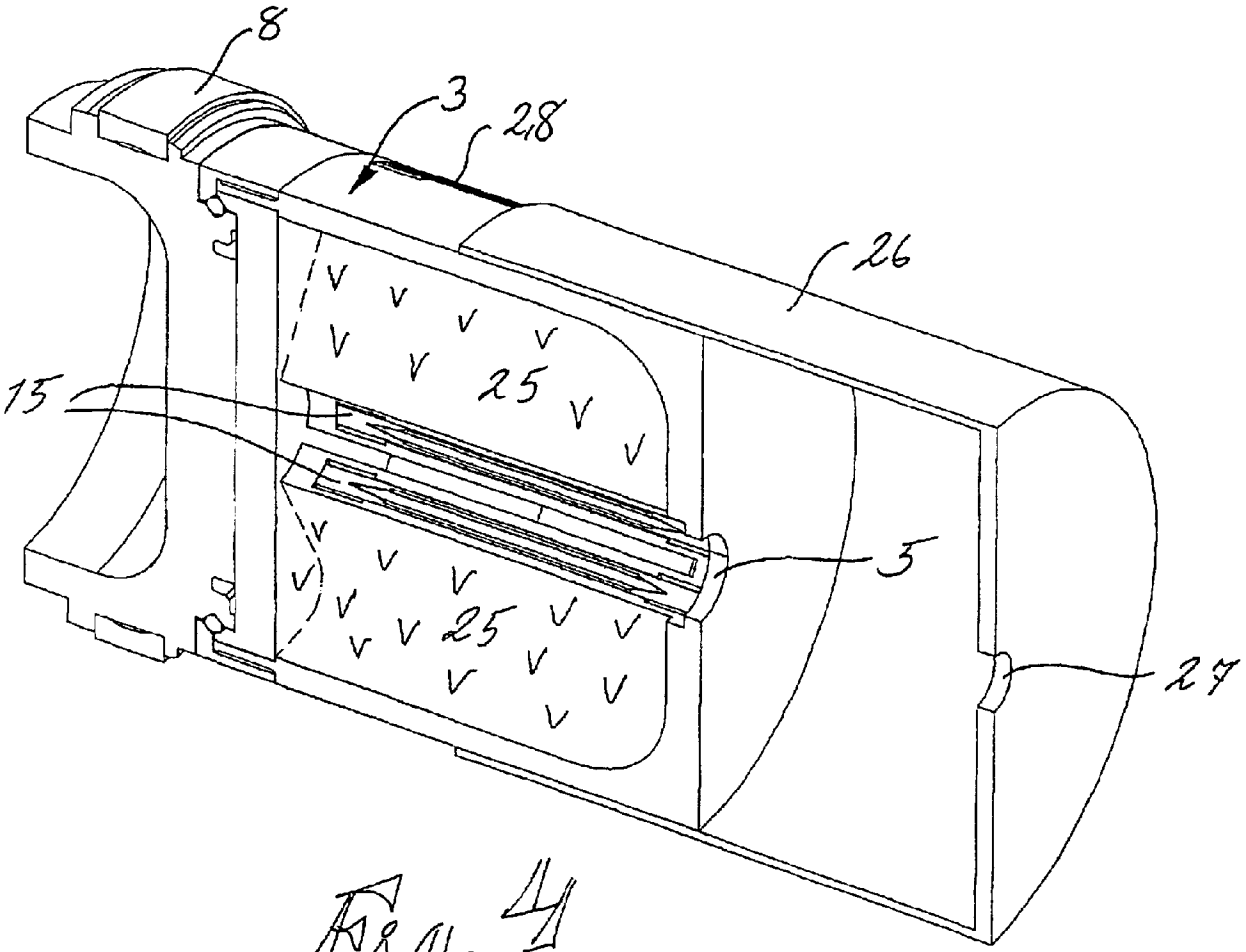
FIGS. 4 & 5 show the same projection as FIG. 3 during different phases of fin deployment.
Figure 5:
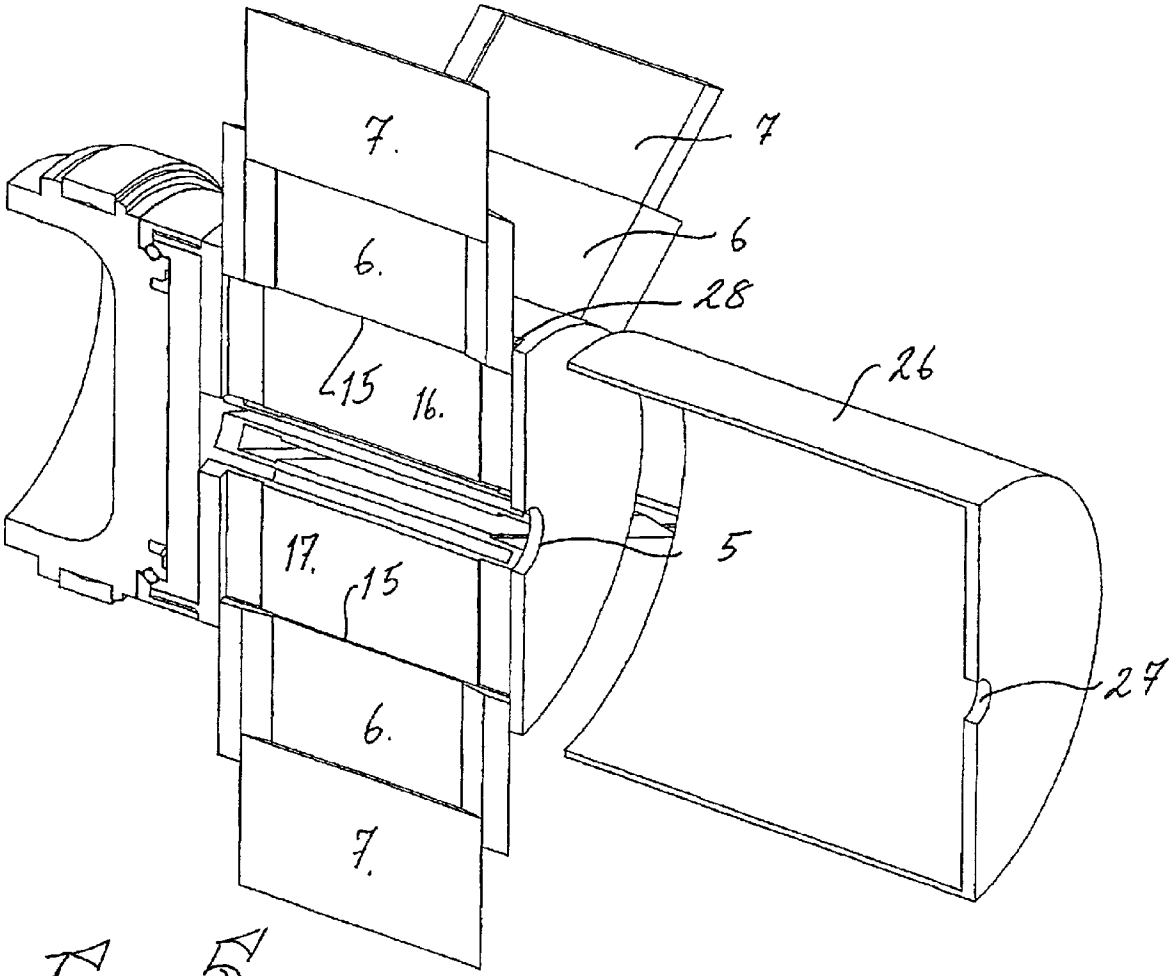

The shell 1 illustrated in FIG. 1 has a front section 2 that can contain a fuze, arming and safety functions, control functions and cargo. These parts are not part of the present invention and will thus not be commented on further. In the rear section of the shell 1 there is a base-bleed unit with the general designation 3. Immediately in front of the base-bleed unit 3 there is a groove in the shell body in which the slipping plastic driving band 8 is mounted. The base-bleed unit 3 contains a propellant chamber 4 and a centrally located gas outlet 5. The shell 1 is also equipped with a number of deployable fins 9–14 that are shown in deployed mode in FIGS. 1 and 5, and in retracted mode in FIGS. 2, 3 and 4. Each of the fins consists of an inner primary fin 6 retracted in the shell body or, more precisely, in the base-bleed unit 3, and a telescopic secondary fin 7 retracted/telescoped into the said primary fin. Each of the primary fins 6 is radially guided and radially displaceable between supporting, protective walls 16 and 17 respectively (see FIG. 3) arranged on each side of each said primary fin, and as the inner longitudinal edges 15 of the primary fins 6 also have free contact with the inside of the propellant chamber 4, as soon as the primary fins leave the barrel they are pressed outwards to deploy through their respective slots 28 in the wall of the shell body in the way previously described by the remaining pressure from the barrel phase, possibly supplemented by the pressure from the newly ignited base-bleed propellant. In a corresponding way the secondary fins 7 are mounted displaceably in the primary fins 6, and are also dependent on propellant gas pressure in the propellant chamber 4 for deployment. Until shell 1 has left the barrel of the gun from which it is fired by a certain margin, the base-bleed unit and the retracted fins are covered by a protective casing 26. As illustrated in FIG. 2 the protective casing 26 initially covers the rear section of the shell and thereby retains the fins in retracted mode. This mode is shown in FIG. 2. By giving the gas pressure that propels the shell during the actual firing free access to the inside of the protective casing 26 via a separate opening 27 in the said casing, a high overpressure is generated inside the protective casing 26 but when the said shell exits the muzzle of the gun fired the pressure outside the protective casing 26 falls extremely rapidly while the pressure inside the protective casing cannot possibly fall equally rapidly. The result is that the overpressure inside the protective casing 26 becomes so great that it ejects the said casing rearwards from the outside of the base-bleed unit 3 as illustrated in FIGS. 4 and 5.

Simultaneously with, or immediately after, ejection of the protective casing 26 the propellant charge of the base-bleed unit 3 is initiated and the remaining pressure from the barrel phase is simultaneously used to force the primary and secondary fins 6 and 7 outwards to deploy. When the primary fins 6 reach their respective outermost position their respective inner longitudinal edges 15 seal the slots in the wall of the base-bleed unit through which the said primary fins deployed, while the gas pressure also deploys the secondary fins 7 to a correspondingly sealed and locked outer position.

Figure 3:
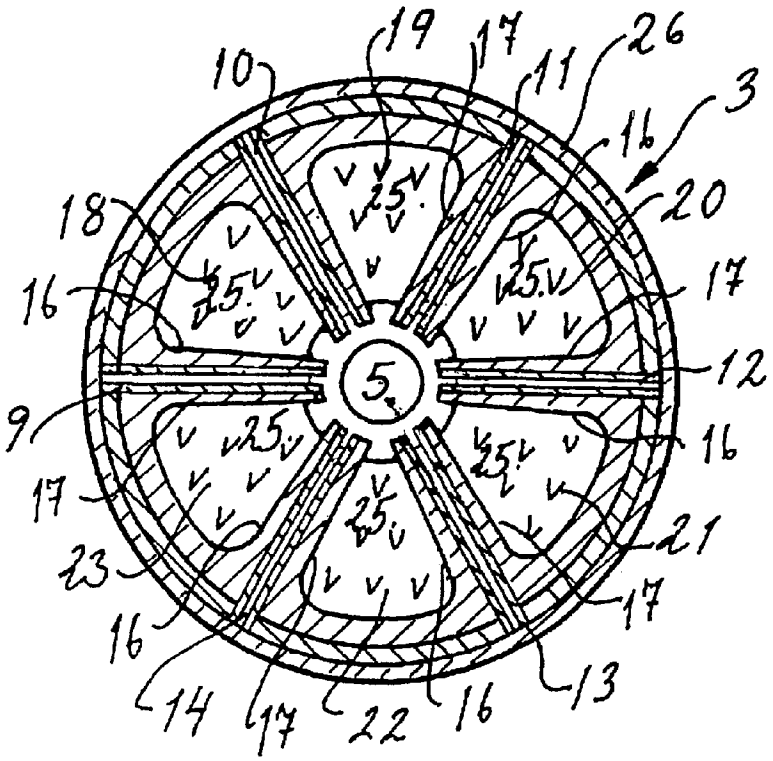

As illustrated primarily in FIG. 3 the primary fins 6 in retracted mode are enclosed on both sides by the previously mentioned supporting, protective walls 16 and 17 that form an integral temperature resistant lining of the propellant chamber 4 of the base-bleed unit, such that the pair of supporting, protective walls of each two adjacent fins divide the propellant chamber 4 into a number of sectors or segments designated 18–23 in the figures, each such sector initially containing a dedicated quantity of propellant or propellant body 25. Extending through the base-bleed unit 3 there is a central propellant gas and initiation channel 24 that is common to all the sectors 18–23 of the propellant chamber 4 as each such sector is exposed to the said channel.

As each of the propellant sectors 18–23 are restricted in size in this way and are provided with good lateral support by the protective walls 16–17 of the adjacent fins 9–14 it is possible to eliminate any risk of damage to the propellant charge of the base-bleed unit during firing, i.e. before it comes into use, while this subdivision into sectors also enables good strength properties for the propellant bodies right up to burnout.

What is claimed is:

1. An artillery shell comprising:

a base-bleed unit to increase the range of the shell; and fins for stabilization in trajectory, wherein the fins when activated, are radially displaceable to project outside an external periphery of the shell through slots or through-holes in a wall of the shell, and when the fins are in a retracted position they are retracted into a propellant motor section or propellant chamber of the base-bleed unit between dedicated protective walls, wherein the protective walls isolate the fins from the surrounding propelling charges of a propellant motor and divide the inside of the propellant motor into sectors that are separated from each other.

2. An artillery shell comprising:

a base-bleed unit to increase the range of the shell; and fins for stabilization in trajectory, wherein the fins when activated, are radially displaceable to project outside an external periphery of the shell through slots or through-holes in a wall of the shell, when the fins are in a retracted position they are retracted into a propellant motor section or propellant chamber of the base-bleed unit between dedicated protective walls, wherein the protective walls isolate the fins from surrounding propelling charges of a propellant motor and divide the inside of the propellant motor into sectors that are separated from each other, and the fins that are initially radially retracted and their surrounding protective walls leave a central propellant gas channel free in the centre of the propellant chamber when the fins are in retracted mode.

3. An artillery shell comprising:

a base-bleed unit to increase the range of the shell; and fins for stabilization in trajectory, wherein the fins when activated, are radially displaceable to project outside an external periphery of the shell through slots or through-holes in a wall of the shell, when the fins are in a retracted position they are retracted into a propellant motor section or propellant chamber of the base-bleed unit between dedicated protective walls, wherein the protective walls isolate the fins from surrounding propelling charges of a propellant motor and divide the inside of the propellant motor into sectors that are separated from each other, and each fin is divided into two or more telescopically retractable elements.

4. An artillery shell as claimed in claim 1 wherein the shell deploys the fins after the shell has left a barrel by utilising residual barrel pressure inside the propellant chamber of the base-bleed unit alternatively supplemented by propellant gas pressure from the propellant charges contained in the propellant chamber when the propellant changes are ignited.

5. An artillery shell as claimed in claim 1 wherein the shell is fired from a barrel of a weapon, and wherein until the shell has left the barrel the shell has a protective casing covering the retracted fins and the base-bleed unit that is removable rearwards, in relation to a direction of flight of the shell, which casing via a dedicated opening has access to overpressure prevailing in the barrel.

6. An artillery shell as claimed in claim 1 wherein the inner longitudinal edges of the fin elements facing the propellant chamber, when deployed in their outermost position, close their respective slots or through-holes in the propellant chamber of the base-bleed unit.

7. An artillery shell as claimed in claim 2 wherein each fin is divided into two or more telescopically retractable elements.

8. An artillery shell as claimed in claim 2 wherein the shell deploys the fins after the shell has left the band by utilising residual band pressure inside the propellant chamber of the base-bleed unit alternatively supplemented by the propellant gas pressure from the propellant change contained in the chamber when the changes are ignited.

9. An artillery shell as claimed in claim 3 wherein the shell deploys the fins after the shell has left the barrel by utilizing the residual barrel pressure maids the propellant chamber of the base-bleed unit alternatively supplemented by the propellant gas pressure from the propellant charge contained in the chamber when the charge is ignited.

10. An artillery shell as claimed in claim 2 wherein until it has left a barrel from which it is fired the said shell has a protective casing coveting the retracted fins and the base-bleed unit that is removable rearwards, in relation to the direction of flight, which casing via a dedicated opening has access to overpressure prevailing in the barrel.

11. An artillery shell as claimed in claim 3 wherein until it has left a barrel from which it is fired the said shell has a protective casing covering the retracted fins and the base-bleed unit that is removable rearwards, in relation to the direction of flight, which casing via a dedicated opening has access to overpressure prevailing in the barrel.

12. An artillery shell as claimed in claim 4 wherein until it has left the barrel from which it is fired the said shell has a protective casing covering the retracted fins and the base-bleed unit that is removable rearwards, in relation to the direction of flight, which casing via a dedicated opening has access to overpressure prevailing in the barrel.

13. An artillery shell as claimed in claim 2 wherein inner longitudinal edges of the fin elements facing the propellant chamber, when deployed in their outermost position, close their respective slots or through-holes in the propellant chamber of the base-bleed unit.

14. An artillery shell as claimed in claim 3 wherein inner longitudinal edges of the fin elements facing the propellant chamber, when deployed in their outermost position, close their respective slots or through-holes in the propellant chamber of the base-bleed unit.

15. An artillery shell as claimed in claim 4 wherein inner longitudinal edges of the fin elements facing the propellant chamber, when deployed in their outermost position, close their respective slots or through-holes in the propellant chamber of the base-bleed unit.

16. An artillery shell as claimed in claim 5 wherein the inner longitudinal edges of the fin elements facing the propellant chamber, when deployed in their outermost position, close their respective slots or through-holes in the propellant chamber of the base-bleed unit.

17. An artillery shell as claimed in claim 1 wherein each fin is divided into two or more telescopically retractable elements.

18. An artillery shell as claimed in claim 7 wherein the shell deploys the fins after the shell has left the barrel by utilising residual barrel pressure inside the propellant chamber of the base-bleed unit alternatively supplemented by the propellant gas pressure from the propellant charges contained in the said chamber when the charge is ignited.

19. An artillery shell comprising:

a front section; and a base-bleed unit, comprising:

a propellant section housing propellant;

fins for stabilization of the shell's trajectory; and walls disposed between the propellant and the fins, wherein the fins are radially displaceable from a retracted position within the base-bleed unit to a position projecting outside a periphery of the shell, and when the fins are retracted into the propellant section of the base-bleed unit between the walls, the walls isolate the fins from the propelling charges and divide the inside of the propellant section into separate sectors.

20. An artillery shell as claimed in claim 19 wherein each fin comprises two or more telescopically retractable elements.

21. An artillery shell as claimed in claim 19 wherein the walls leave a central propellant gas channel free in the centre of the propellant section when the fins are retracted.

22. An artillery shell as claimed in claim 19 comprising:

a removable casing surrounding the base bleed unit when the fins are in a retracted position.

23. An artillery shell as claimed in claim 22 wherein an opening introduces overpressure into the casing during firing.

24. An artillery shell comprising:

a front section; and a base-bleed unit, comprising:

a propellant section housing propellant; and fins for stabilization of the shell's trajectory, wherein the fins are radially displaceable from a retracted position within the base-bleed unit and surrounded by propellant, to a position projecting outside a periphery of the shell, and each fin comprises two or more telescopically retractable elements.

25. An artillery shell as claimed in claim 24 comprising:

a removable casing surrounding the base bleed unit when the fins are in a retracted position.

* * * * *